US005224872A

United States Patent [19]

Noda et al.

[11] Patent Number: 5,224,872

[45] Date of Patent: Jul. 6, 1993

[54] SWITCH CONNECTOR ASSEMBLY WITH WATERPROOF STRUCTURE

[75] Inventors: Hirotaka Noda; Nobutoshi Hagiwara; Keiichi Ito, all of Aichi; Tetsuaki Suzuki, Shizuoka; Yasuhiro Onodera, Shizuoka; Shinji Kodama, Shizuoka, all of Japan

[73] Assignee: Yazaki Corporation, Tokyo, Japan

[21] Appl. No.: 961,950

[22] Filed: Oct. 16, 1992

[30] Foreign Application Priority Data

Oct. 17, 1991 [JP] Japan ..... 3-84573[U]

[51] Int. Cl.[5] ..... H01R 13/00

[52] U.S. Cl. ..... 439/282; 439/514

[58] Field of Search ..... 439/271-282, 439/507, 509, 514

[56] References Cited

U.S. PATENT DOCUMENTS

| | | | |
|---|---|---|---|
| 4,571,017 | 2/1986 | Fujita | 439/282 |
| 4,842,541 | 6/1989 | Leandris | 439/282 |
| 5,158,391 | 10/1992 | Fujitani et al. | 439/271 |

FOREIGN PATENT DOCUMENTS

| | | |
|---|---|---|
| 60-60342 | 4/1985 | Japan . |
| 3-95578 | 9/1991 | Japan . |

*Primary Examiner*—Joseph H. McGlynn
*Attorney, Agent, or Firm*—Armstrong, Westerman, Hattori, McLeland & Naughton

[57] ABSTRACT

A switch connector assembly with a waterproof structure which prevents admission of water thereinto without certainty and complete fitting between male and female connectors can be confirmed readily. The female connector has a short-circuiting terminal extending into a connector fitting chamber thereof and further has a temporary arresting projection and a flexible locking arm having a final arresting projection thereon. The male connector has a connecting terminal, a flexible engaging pawl, and an engaging portion. The short-circuiting terminal and the connecting terminal are kept out of contact with each other when the temporary arresting projection is fitted with the flexible engaging pawl, but contact with each other when the final arresting projection is fitted with the engaging portion. A sliding seal is provided on an outer periphery of the male connector and is engaged, upon insertion of the male connector into the connector fitting chamber, with the inner wall of the connector fitting chamber simultaneously with fitting of the temporary arresting projection and the flexible engaging pawl with each other.

6 Claims, 17 Drawing Sheets

SWITCH CONNECTOR ASSEMBLY WITH WATERPROOF STRUCTURE

BACKGROUND OF THE INVENTION

1. Field of the Invention

This invention relates to a switch connector assembly with a waterproof structure which is used to connect and disconnect a fuse circuit for a dark current directly coupled to a battery of a vehicle.

2. Description of the Prior Art

A switch connector assembly is popularly used to connect and disconnect a fuse circuit for a dark current directly coupled to a battery of a vehicle such as an automobile.

An exemplary one of conventional electric circuits which employ a switch connector assembly for the connection and disconnection of a dark current circuit for an automobile is disclosed in Japanese Utility Model Laid-Open Application No. 60-60342 and is shown in FIG. 17.

Referring to FIG. 17, the electric circuit shown includes a battery power source 60, a switch 61 disposed between the battery power source 60 and an electric equipment 62 of the automobile, an electric connecting box 63 in which a dark current fuse 65 connected to a power supply line 64 is provided, and a switch connector assembly 66 provided integrally with the electric connecting box 63 and connected to the dark current fuse 65.

The switch connector assembly 66 is formed from a pair of male and female connectors 67 and 68 for fitting with each other to establish electric connection between the electric connecting box 63 and a plurality of dark current parts 69 provided on the automobile such as a clock. The male and female connectors 67 and 68 of the switch connector assembly 66 are kept disconnected from each other after the automobile has been shipped until it is delivered to a user so that the dark current parts 69, which are otherwise coupled to the battery power source 60 by way of no switch, are kept electrically disconnected from the battery power source 60 in order to prevent otherwise possible exhaustion of the battery 60.

Another switch connector assembly is disclosed in Japanese Utility Model Laid-Open application No. 3-95578 which includes a temporary arresting mechanism and a final arresting mechanism for connectors.

None of the conventional switch connector assemblies, however, has a waterproof structure. Accordingly, if the switch connector assembly is disposed, for example, in an engine room of an automobile, there is the possibility that water may be admitted into the switch connector assembly and cause incomplete contact between contacts of the male and female connectors of the switch connector assembly. Therefore, a good waterproof structure for a switch connector assembly is demanded.

SUMMARY OF THE INVENTION

It is an object of the present invention to provide a switch connector assembly with a waterproof structure which prevents admission of water thereinto without certainty.

It is another object of the present invention to provide a switch connector assembly with a waterproof structure wherein complete fitting between male and female connectors can be confirmed readily.

In order to attain the object, according to the present invention, there is provided a switch connector assembly with a waterproof structure, which comprises a first connector having a connector fitting chamber formed therein and having a short-circuiting terminal extending therefrom into the connector fitting chamber, the first connector having thereon a temporary arresting projection and a flexible locking arm having a final arresting projection thereon, a second connector for being inserted in the connector fitting chamber, the second connector having thereon a connecting terminal for contacting with the short-circuiting terminal, a flexible engaging pawl for engaging with the temporary arresting projection, and an engaging portion for engaging with the final arresting projection, the first and second connectors being so shaped and dimensioned that the short-circuiting terminal and the connecting terminal are kept out of contact with each other when the temporary arresting projection is fitted with the flexible engaging pawl, but contact with each other when the final arresting projection is fitted with the engaging portion, and a sliding seal provided on an outer peripheral wall adjacent an end of the second connector for engaging with an inner wall of the connector fitting chamber, the sliding seal being located so as to be engaged, when the second connector is inserted into the connector fitting chamber of the first connector, with the inner wall of the connector fitting chamber simultaneously when the temporary arresting projection and the flexible engaging pawl are fitted with each other.

With the switch connector assembly, since it is provided with a superior waterproof performance by the sliding seal, it can be disposed in an engine room or the like without the possibility of admission of water thereinto. Further, since the sliding seal is engaged with the inner wall of the connector fitting chamber simultaneously when the first connector is temporarily fitted with the second connector, whereupon the temporary arresting projection and the flexible engaging pawl are engaged with each other, peaks of the loads upon insertion of the first and second connectors with each other coincide with each other. Accordingly, an operator can confirm temporary fitting of the first and second connectors with each other readily from a feeling of the hand thereof.

Preferably, it further comprises a fixing seal provided on the outer peripheral wall adjacent a base end of the second connector, the fixing seal being closely contacted with the second connector simultaneously when the final arresting projection and the engaging portion are fitted with each other upon insertion of the second connector into the connector fitting chamber of the first connector. Thus, the fixing seal is closely contacted with the inner wall of the connector fitting chamber simultaneously with final fitting of the first and second connectors with each other, and thereupon, the final arresting projection is fitted with the engaging portion. Accordingly, the operator can sense complete fitting of the first and second connectors with each other with certainty from a peak of the load upon insertion of the first and second connectors. The sliding seal and the fixing seal may be formed as a unitary member.

Preferably, a taper guide is formed at an opening end portion of an inner wall of the connector fitting chamber for guiding the sliding seal upon insertion of the second connector into the connector fitting chamber.

Insertion of the second connector into the connector fitting chamber is facilitated by the taper guide.

Preferably, a recessed groove is provided circumferentially at an intermediate portion of an inner wall of the connector fitting chamber in the inserting direction of the second connector into the first connector in such a manner that the sliding seal is not contacted with the inner wall of the fitting chamber when the second connector is inserted into the connector fitting chamber. Preferably, the recessed groove extends to an opening end portion of the connector fitting chamber. The recessed groove decreases the resistance of the sliding seal upon insertion of the second connector into the connector fitting chamber.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
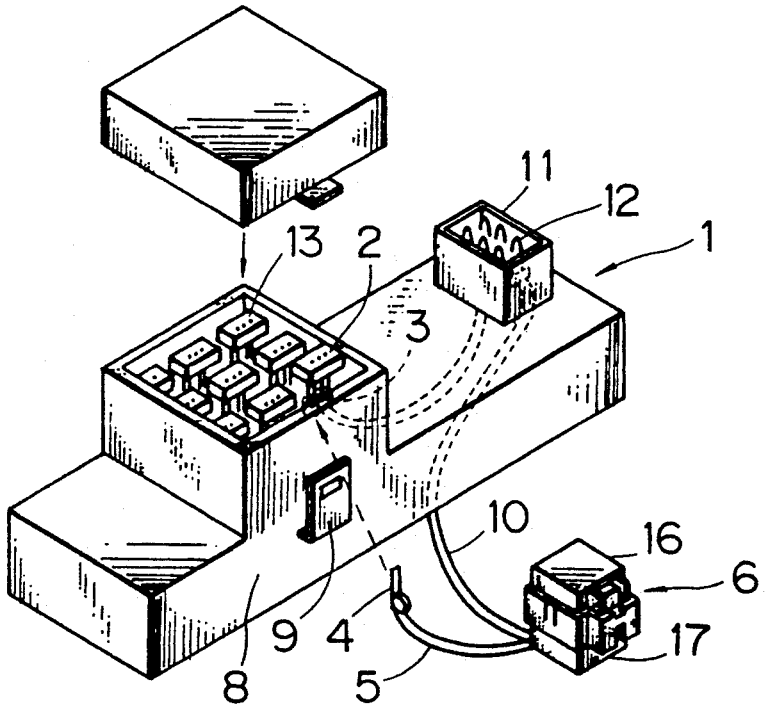
FIG. 1 is a fragmentary perspective view showing a switch connector assembly connected to an electric connecting box of an automobile.

Referring first to FIG. 1, there is shown a switch connector assembly to which the present invention can be applied. The switch connector assembly 6 is connected to an electric connecting box 1 carried on a vehicle not shown.

More particularly, the switch connector assembly 6 is connected, by way of a lead wire 5 having a male terminal 4 at an end thereof, to an inserting portion (female terminal) 3 of a fuse 2 for a dark current provided in the inside of the electric connecting box 1, and is secured to a bracket 9 of an outer wall 8 of the electric connecting box 1. The switch connector assembly 6 is connected by way of a lead wire 10 to a terminal 12 of a connector 11 to which a plurality of dark current parts such as a clock not shown are connected.

Figure 2:
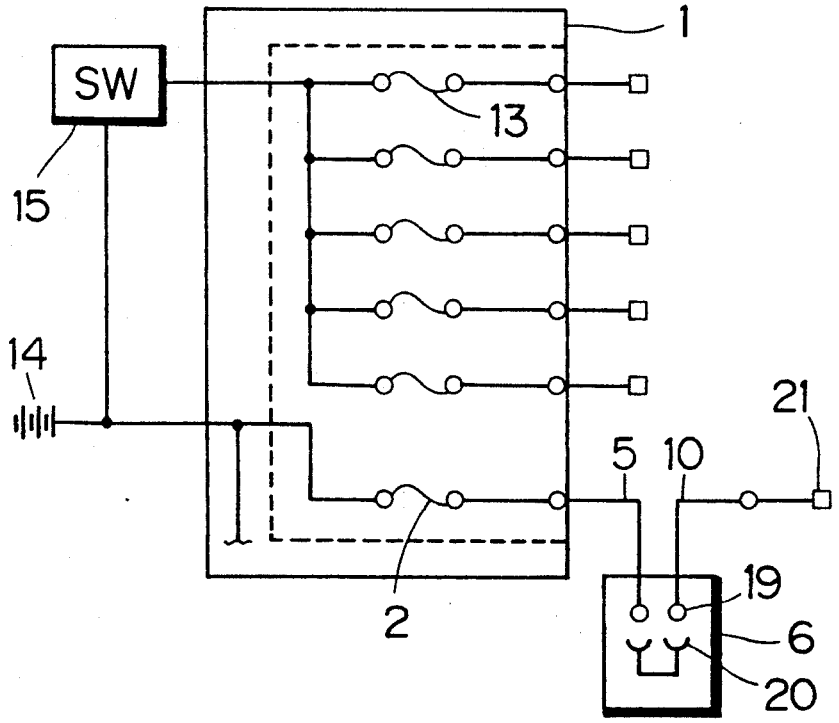
FIG. 2 is a circuit diagram showing the switch connector assembly and the electric connecting box shown in FIG. 1.

Referring now to FIG. 2, there is shown an electric circuit including the switch connector assembly and the electric connecting box shown in FIG. 1. A plurality of fuses 13 for general electric circuits are provided in the electric connecting box 1, and electric current flows from a battery 14 to the fuses 13 by way of an ignition switch 15. Meanwhile, electric current is supplied from the battery to the switch connector assembly 6 by way of the dark current fuse 2 but without passing a switch. Thus, energization of a dark current part 21 is stopped and resumed by disconnection and connection of two pairs of terminals 19 and 20 in the switch connector assembly 6 by fitting and separation of male and female connectors 17 and 16 (FIG. 1) with and from each other.

Figure 3:
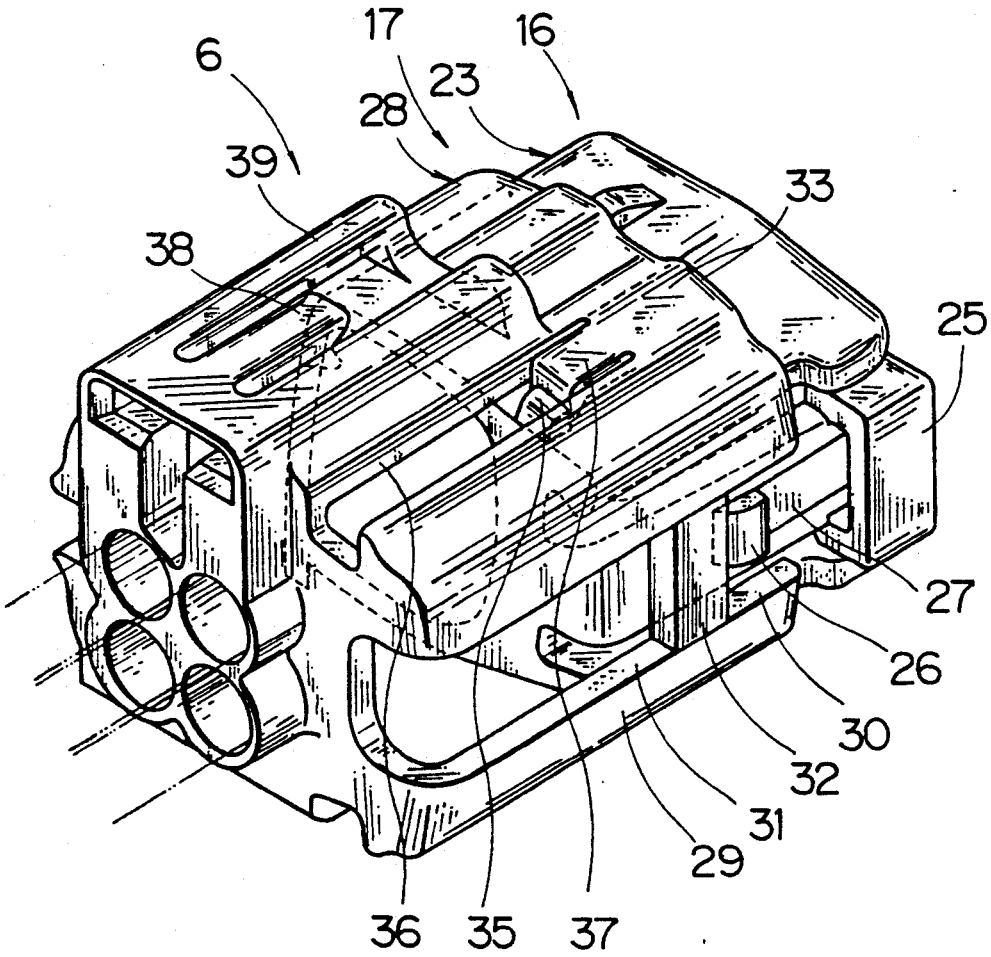
FIG. 3 is a schematic perspective view of a switch connector assembly showing a first preferred embodiment of the present invention.
Figure 4:
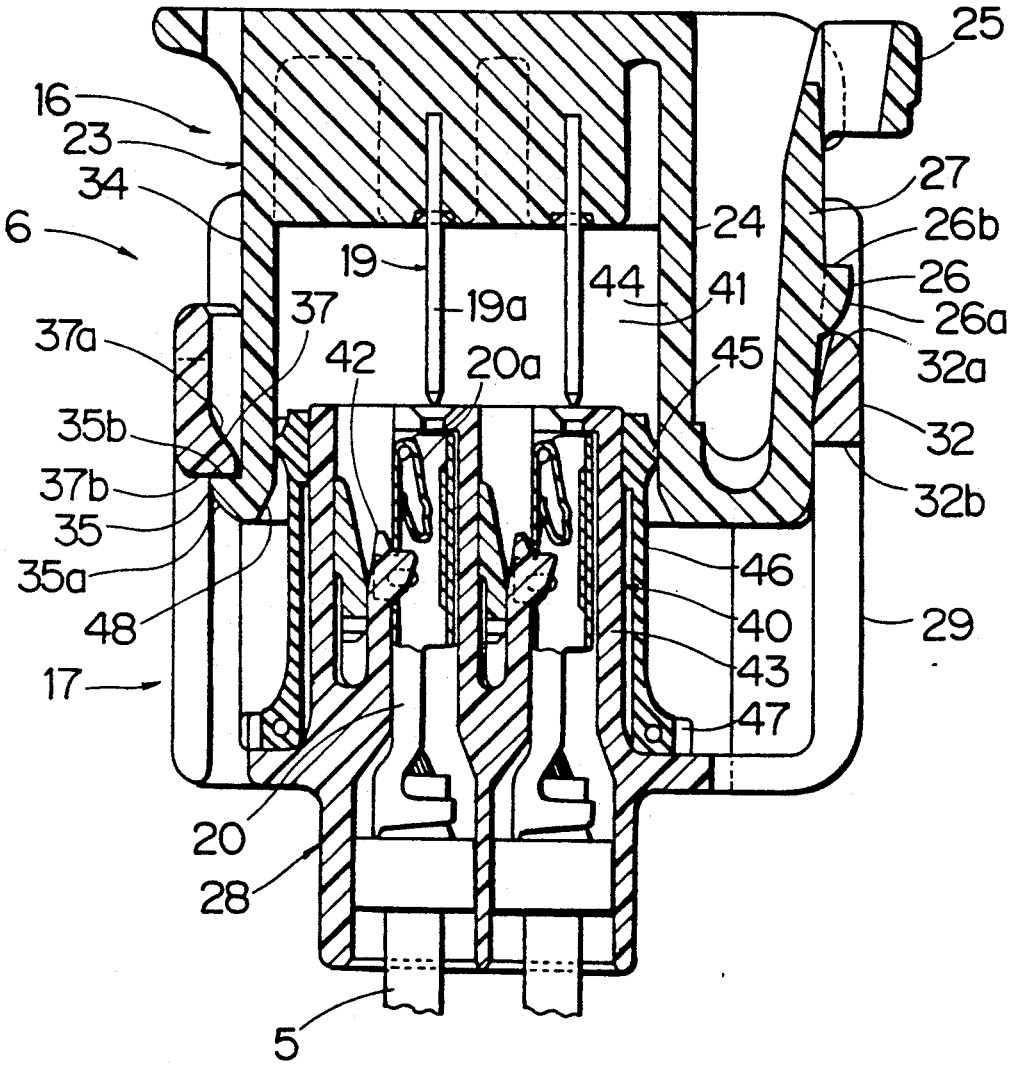
FIG. 4 is a longitudinal sectional view of the switch connector assembly of FIG. 3 when the male and female connectors thereof are temporarily fitted with each other.

Referring now to FIGS. 3 and 4, there is shown a switch connector assembly to which the present invention is applied. The switch connector assembly 6 includes a female connector 16 and a male connector 17 for engaging with the female connector 16 for sliding movement within a fixed range.

A flexible locking arm 27 for locking the female and male connectors 16 and 17 in a finally fitted condition is formed contiguously on and extends upwardly from a lower end portion of a front wall 24 of a housing 23 of the female connector 16 made of a synthetic resin. The flexible locking arm 27 has a pressing portion 25 for manual operation formed at an end thereof and has a final arresting projection 26 formed at an intermediate portion thereof. A guide wall 29 for guiding the flexible locking arm 27 is formed in a swollen condition on a housing 28 of the male connector 17, and a pair of lower and upper recesses 30 and 31 are formed at horizontally a central portion of the guide wall 29 so as to define therebetween an engaging wall portion 32 having a pair of upper and lower receiving faces **32*a* and 32*b* for engaging with final arresting projection 26 of the flexible locking arm 27 of the housing 23 of the female connector 16. The final arresting projection 26 has a downwardly directed inclined face 26***a* and an upwardly directed horizontal arresting face 26*b* thereon.

A temporary arresting projection 35 is formed on each of a side wall 33 and a rear wall 34 of the female housing 23 and has a downwardly directed inclined face 35*a* and an upwardly directed horizontal face 35*b* formed thereon. A pair of insertion grooves 36 for receiving the temporary arresting projections 35 of the female housing 23 are formed on the male housing 28 while a pair of flexible engaging pawls 37 for engaging with the temporary arresting projections 35 are formed by cutting the female housing 23 such that they extend in and along the insertion grooves 36. Each of the flexible engaging pawls 37 has an upwardly directed inclined guide face 37*a* and a downwardly directed horizontal receiving face 37*b* thereon.

A fitting guide wall 39 is formed integrally on the side wall 33 of the male housing 28 and has a flexible locking finger 38 for engaging with bracket 9 of the electric connecting box 1 (FIG. 1) to mount the male connector 16 on the electric connecting box 1.

As particularly seen in FIG. 4, a connector fitting chamber 41 for receiving therein a terminal accommodating portion 40 formed in the inside of the male connector 17 is formed in the inside of the female connector 16, and male tabs 19*a* of a pair of short-circuiting terminals 19 curved in an inverted U-shape in planes perpendicular to the plane of FIG. 4 extend from the female housing 23 into the connector fitting chamber 41 while a pair of female connecting terminals 20 having resilient contact members 20*a* for contacting with the male tabs 19*a* are accommodated in the inside of the male connector 17 and are each fixed by an arresting lance 42 formed integrally on the male housing 28. The terminals 19 and 20 are set such that they do not contact with each other in a temporarily fitted condition of the connectors 16 and 17. The connecting terminals 20 are connected to the electric connecting box 1 (FIG. 1) by way of the lead wire 5.

A waterproof packing 46 is provided on an outer peripheral wall 43 of the terminal accommodating portion 40 of the male connector 17. The waterproof packing 46 has a lip-shaped sliding seal 45 formed at an end thereof for engaging with an inner wall 44 of the connector fitting chamber 41 of the female connector 16. The waterproof packing 46 is arrested and secured to the male housing 28 by means of a hard member 47 provided at a base end portion thereof.

A taper guide 48 for guiding the sliding seal 45 upon insertion into the connector fitting chamber 41 of the female connector 16 is formed at an opening end portion of the connector fitting chamber inner wall 44. The position of the sliding seal 45 is set such that it may be fitted from the taper guide 48 into the connector fitting chamber inner wall 44 simultaneously when the female and male housings 23 and 28 are temporarily fitted with each other fitting of the housings 23 and 28, that is, when the temporary arresting projections 35 ride over the flexible engaging pawls 37 and the final arresting projection 26 is contacted with the upper side receiving face 32*a* of the engaging wall 32 with some play.

Figure 5:
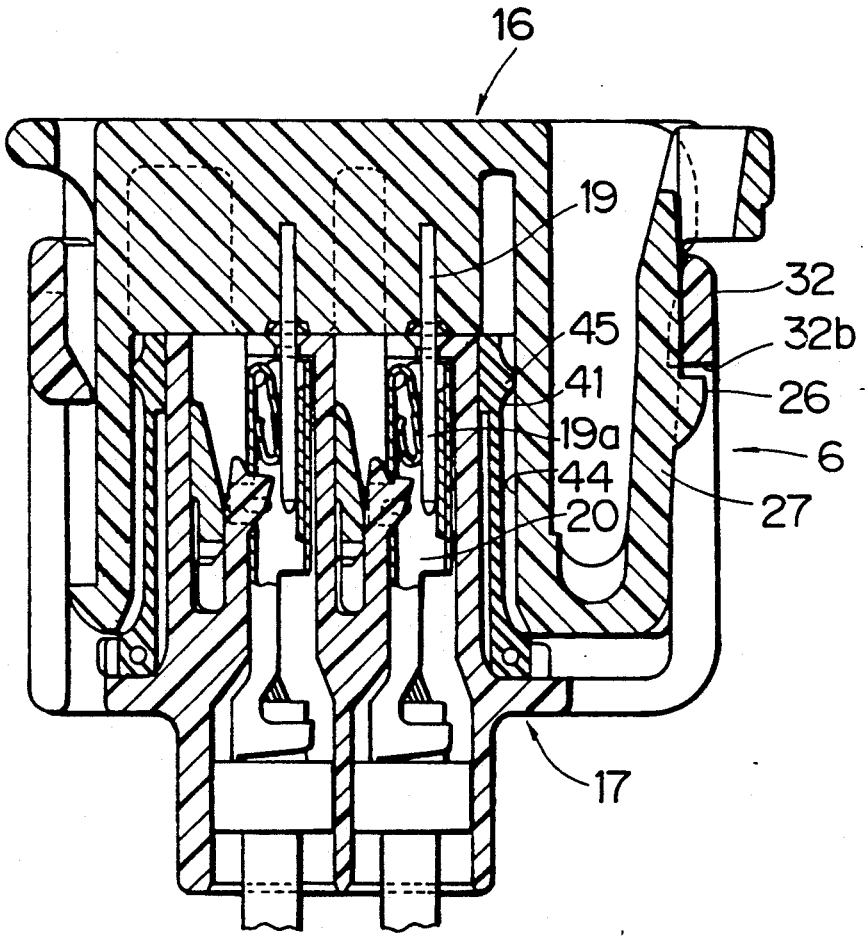
FIG. 5 is a similar view but showing the switch connector assembly of FIG. 3 when the male and female connectors are finally fitted with each other.

FIG. 5 shows the switch connector assembly 6 in a condition wherein the female and male housings 23 and 28 are finally fitted with each other. When the female connector 16 is pushed to move downwardly with respect to the male connector 17 from the condition shown in FIG. 4, the flexible locking arm 27 is yieldably deformed laterally by engagement between the upper side inner face 32*a* of the engaging wall portion 32 and the downwardly direction inclined face 26*a* of the final arresting projection 26 to allow the final arresting projection 26 to ride over the engaging wall portion 32 until the final arresting projection 26 is engaged with the lower side receiving face 32*b* of the engaging wall portion 32 while the male tabs 19*a* of the short-circuiting terminals 19 are inserted into the connecting terminals 20 and simultaneously the sliding seal 45 of the waterproof packing 46 slidably moved on the inner wall face 44 until it is closely contacted with a base end portion of the inner wall face 44 of the connector fitting chamber 41.

Figure 6:
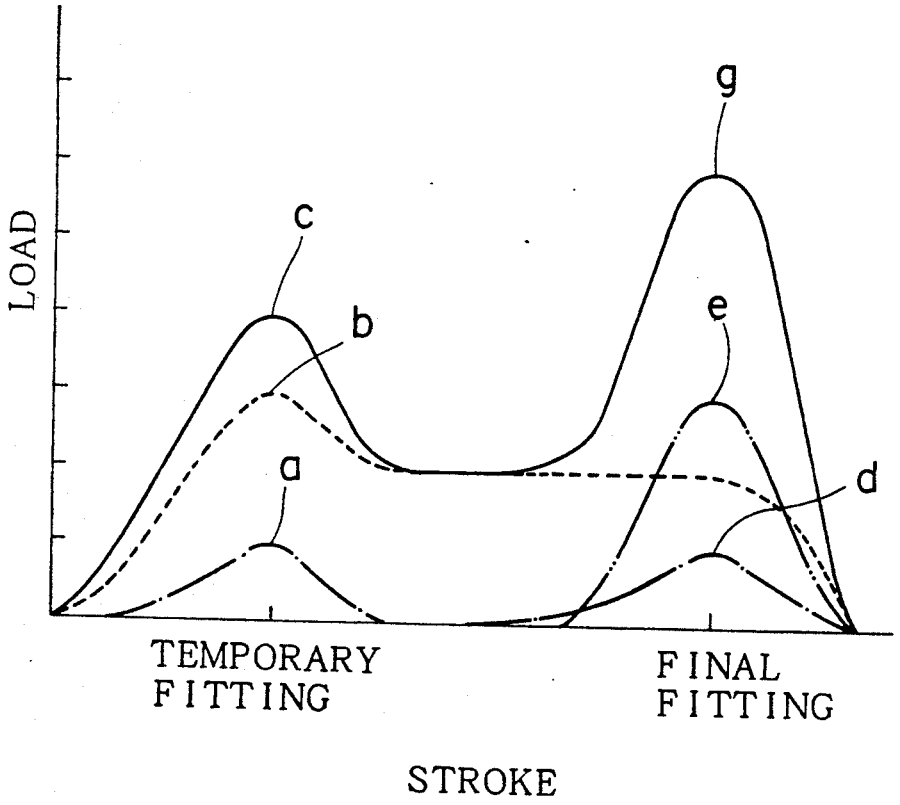
FIG. 6 is a diagram showing a relationship between a connector inserting force and a stroke of the male and female connectors of the switch connector assembly of FIG. 3.

FIG. 6 shows a relationship between a stroke of relative movement of the female and male connectors 16 and 13 and a load, that is, an inserting force required to insert the male connector 13 into the female connector 16.

As seen from FIG. 6, peaks of an inserting force a required to fit the housings 13 and 16 into a temporarily fitted condition with each other and an inserting force b for the sliding seal 45 coincide with each other, and accordingly, the switch connector assembly 6 has a characteristic that an operator can judge from a resultant force c that temporary fitting is reached. In FIG. 6, reference character g denotes a resultant force of an inserting force e of the terminals 19 and an inserting force d required to fit the housings 13 and 16 into a finally fitted condition with each other (the condition wherein the final arresting projection 26 of the flexible locking arm 27 is contacted with the lower side receiving face 32*b* of the engaging wall portion 32), and the positions of the terminals 19 and 20 and the final arresting projection 26 are set such that peaks of the two inserting forces d and e may coincide with each other.

Figure 7:
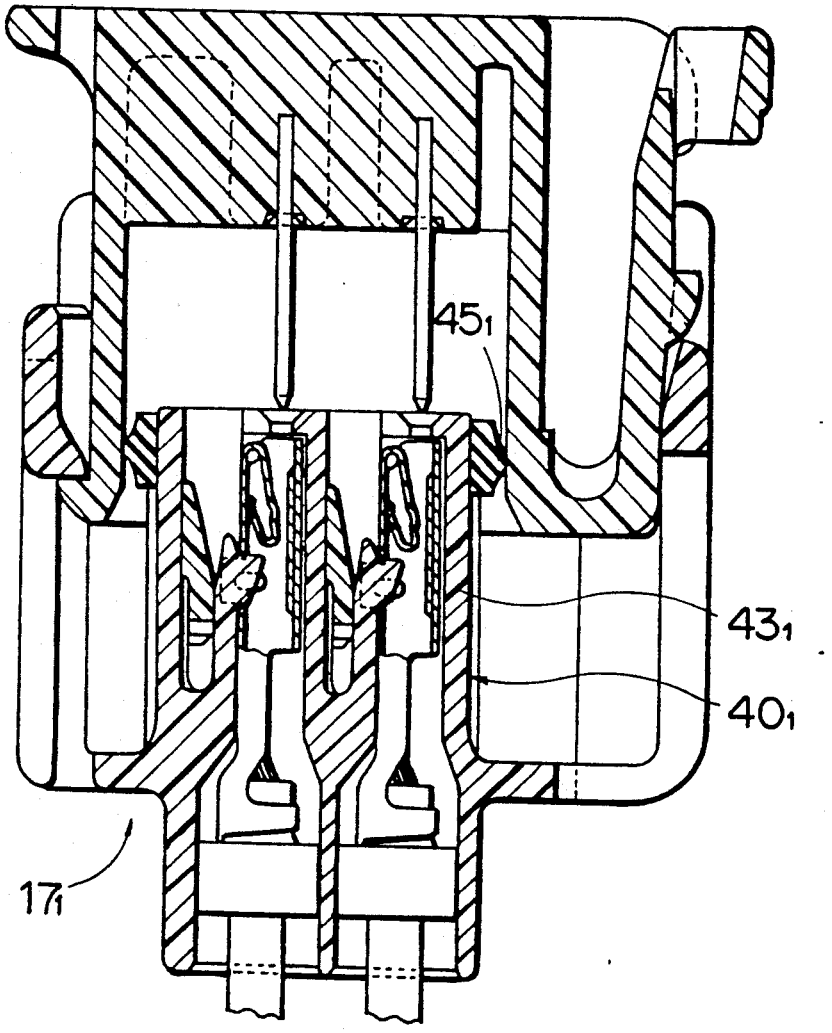
FIG. 7 is a longitudinal sectional view showing a modification to the switch connector assembly of FIG. 4.

Referring now to FIG. 7, there is shown a modification to the switch connector assembly described hereinabove with reference to FIG. 4. The modified switch connector assembly is modified such that the waterproof packing thereof is formed as a mere sliding seal $45_1$ disposed at an end of an outer peripheral wall $43_1$ of a terminal accommodating portion $40_1$ of a male connector $17_1$. The relationships of the connecting inserting forces to the stroke in the present switch connector assembly are similar to those illustrated in FIG. 6.

Figure 8:
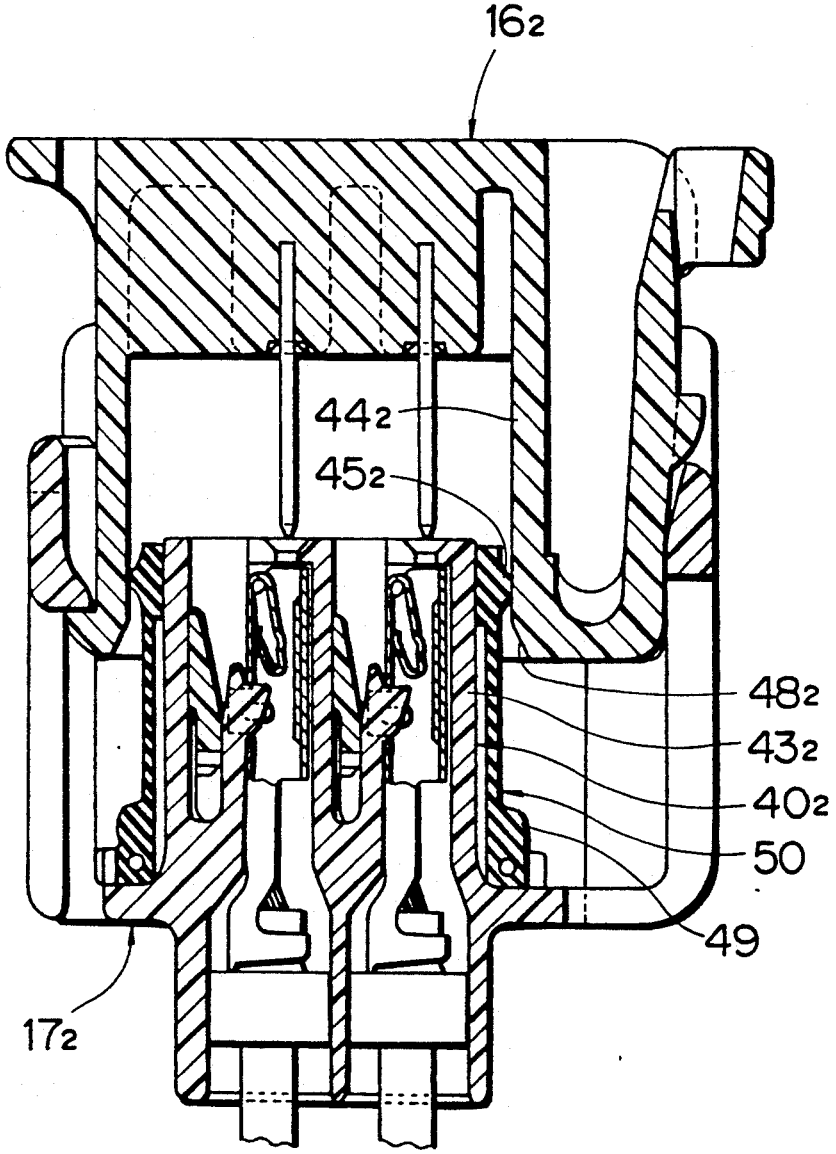
FIG. 8 is a similar view but showing a switch connector assembly of a second preferred embodiment of the present invention when the male and female connectors thereof are temporarily fitted with each other.
Figure 9:
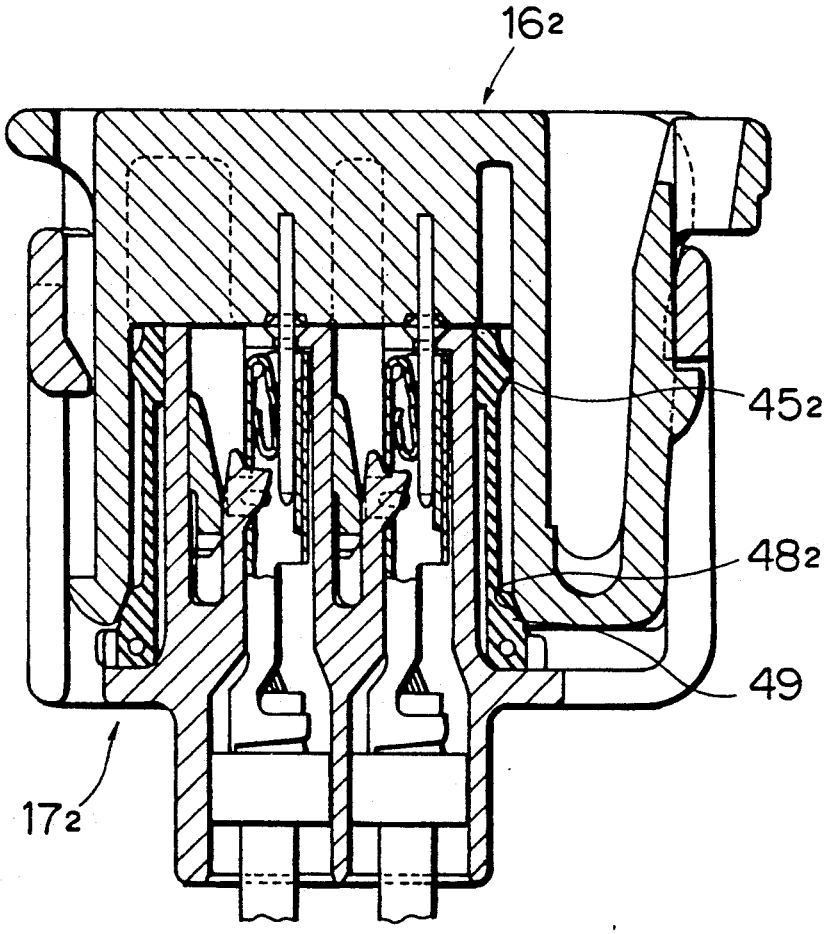
FIG. 9 is a similar view but showing the switch connector assembly of FIG. 8 when the male and female connectors are finally fitted with each other.

Referring now to FIGS. 8 and 9, there is shown a switch connector assembly according to a second preferred embodiment of the present invention. The present switch connector assembly is a modification to the switch connector assembly shown in FIG. 4 and is principally different in that it includes a modified waterproof packing 50 in place of the waterproof packing 46. The modified waterproof packing 50 has a sliding seal $45_2$ disposed at an end of an outer peripheral wall $43_2$ of a terminal accommodating portion $40_2$ of a male connector $17_2$ and a fixing seal 49 disposed at a base end of the outer peripheral wall $43_2$.

Here, the interference of the sliding seal $45_2$ with respect to a connector fitting chamber inner wall $44_2$ is set smaller than the interference of the sliding seal 45 with respect to the connector fitting chamber inner wall 44 in the switch connector assembly of the first embodiment (FIGS. 4 and 7), and the interference of the fixing seal 49 is similarly set substantially equal to the interference of the sliding seal 45 in the first embodiment.

Meanwhile, the position of the fixing seal 49 is set such that it is pressed against and contacted with a taper guide $48_2$ at an opening end of a female connector $16_2$ simultaneously with final fitting of the connectors $16_2$ and $17_2$ with each other as shown in FIG. 9.

Figure 10:
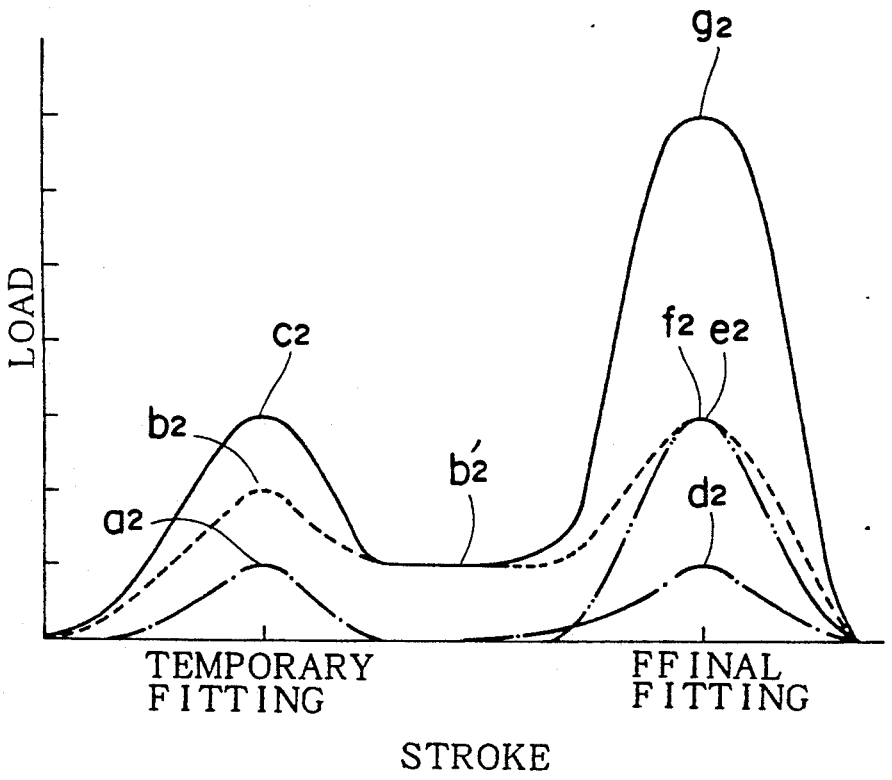
FIG. 10 is a diagram showing a relationship between a connector inserting force and a stroke of the male and female connectors of the switch connector assembly of FIG. 8.

Accordingly, as seen from a diagram of the connector inserting forces in FIG. 10, an inserting force $c_2$ upon temporary fitting (resultant force of the inserting force $a_2$ required for temporary fitting of the housings $16_2$ and $17_2$ with each other and the inserting force $b_2$ for the sliding seal $45_2$) and the inserting force $b_2$ upon pushing stroke are small, and accordingly, an inserting operation is easy. Further, sure waterproof is established by the fixing seal 49 simultaneously with final fitting of the housings $16_2$ and $17_2$. In FIG. 10, reference character $d_2$ denotes an inserting force required for final fitting of the housings $16_2$ and $17_2$, $e_2$ a terminal inserting force, and $f_2$ an inserting force of the fixing seal 49, and since peaks of them coincide with each other, an operator can sense final fitting of the connectors readily from a resultant force $g_2$ of them. It is to be noted that, since the temporarily fitted condition of the connectors $16_2$ and $17_2$ does not continue for a long time and it has the fixing seal 49, the interference of the sliding seal $45_2$ which is effective only upon temporary fitting can be set small.

Figure 11:
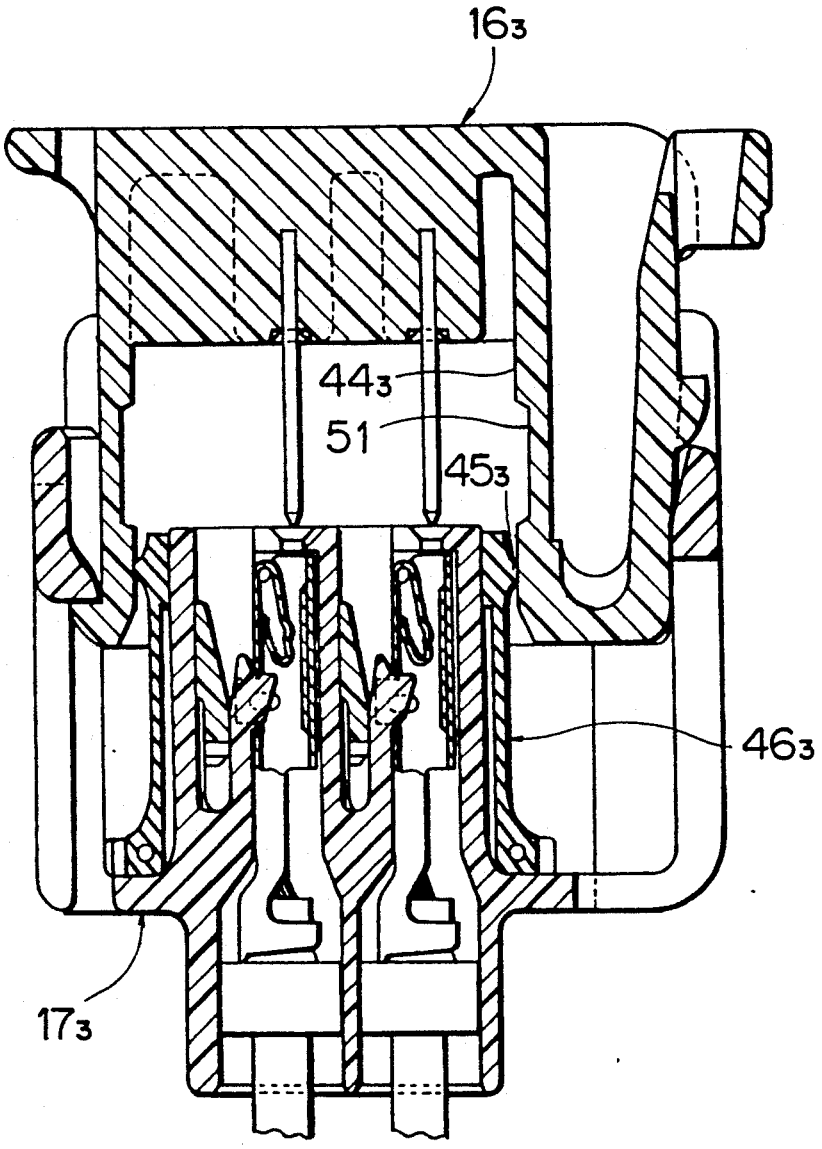
FIG. 11 is a vertical sectional view showing a switch connector assembly of a third preferred embodiment of the present invention when the male and female connectors thereof are temporarily fitted with each other.
Figure 12:
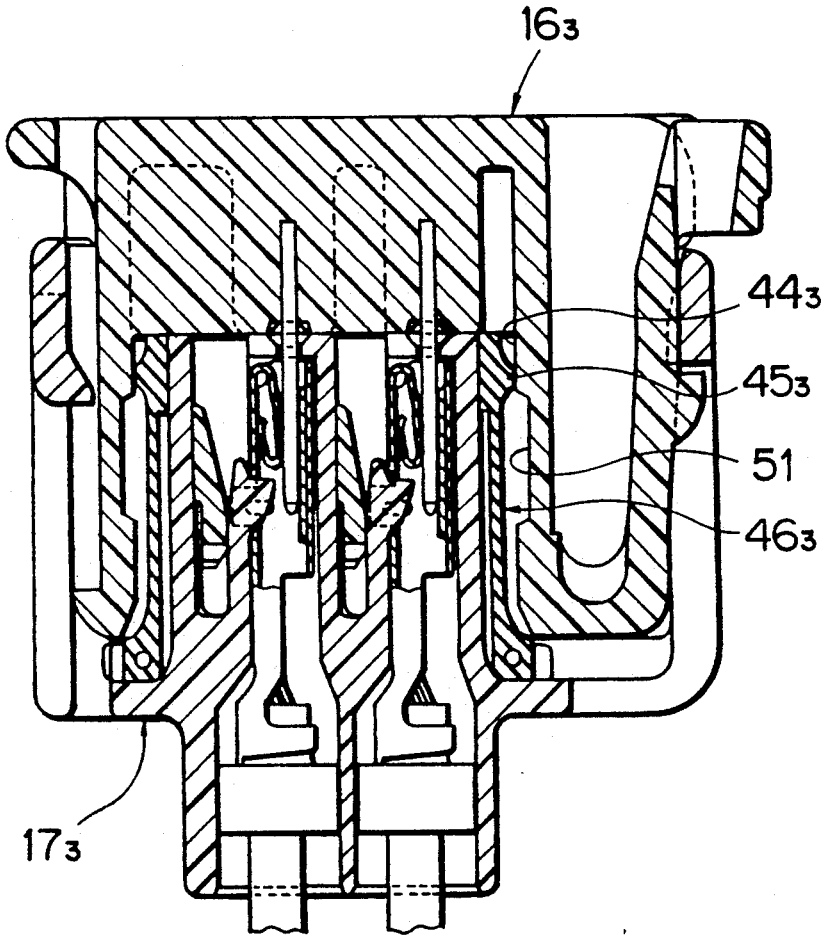
FIG. 12 is a similar view but showing the switch connector assembly of FIG. 11 when the male and female connectors are finally fitted with each other.
Figure 13:
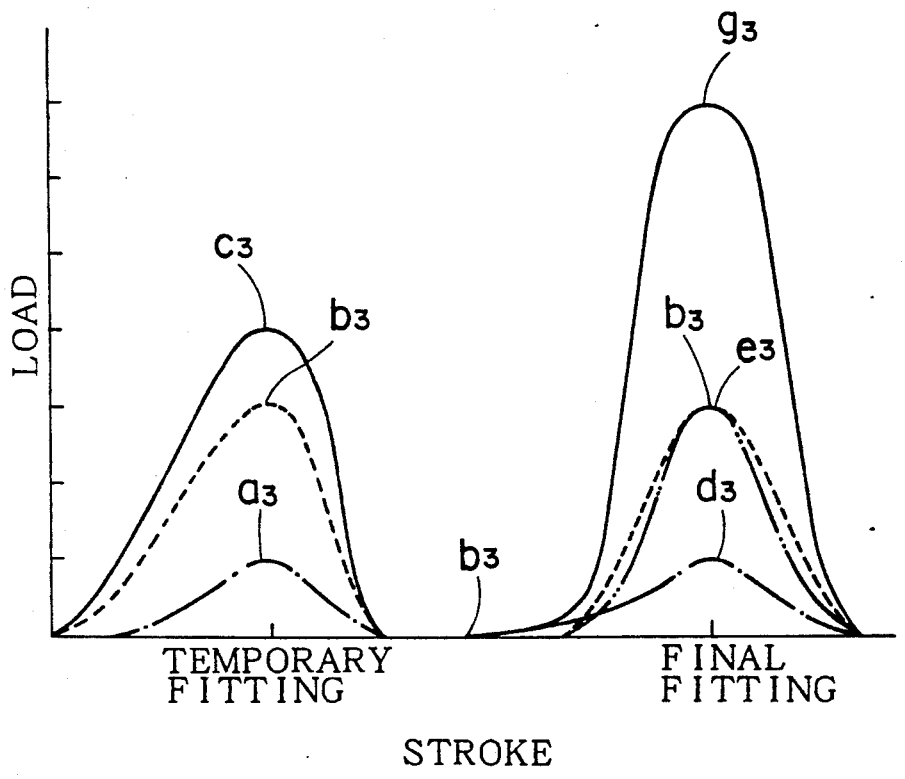
FIG. 13 is a diagram showing a relationship between a connector inserting force and a stroke of the male and female connectors of the switch connector assembly of FIG. 11.

Referring now to FIGS. 11 and 12, there is shown a switch connector assembly according to a third preferred embodiment of the present invention. The present switch connector assembly of a modification to the switch connector assembly of the first embodiment shown in FIG. 4 and is principally different in that a waterproof packing $46_3$ having a sliding seal $45_3$ of the same interference with that of the sliding seal 45 of the first embodiment is mounted on a male connector $17_3$ and a recessed groove 51 for eliminating sliding contact of a fitting chamber inner wall $44_3$ of a female connector $16_3$ with the sliding seal $45_3$ is provided circumferentially at a longitudinally intermediate portion of the fitting chamber inner wall $44_3$ of the female connector $16_3$ so that the sliding resistance $b_3'$ of the sliding seal $45_3$ during pushing in of the connectors $16_3$ and $17_3$ with each other is reduced to zero as seen from FIG. 13. With the structure, the operability in inserting the connectors $16_3$ and $17_3$ with each other is further enhanced. It is to be noted that reference character $c_3$ in FIG. 13 denotes a resultant force of an inserting force $a_3$ required for temporary fitting of the housings $16_3$ and $17_3$ with each other and an inserting force $b_3$ of the sliding seal $45_3$, and $g_3$ a resultant force of an inserting force $d_3$ required for final fitting of the housing $16_3$ and $17_3$ with each other, a terminal inserting force $e_3$ and the sliding seal inserting force $b_3$ (same as that upon temporary fitting).

Figure 14:
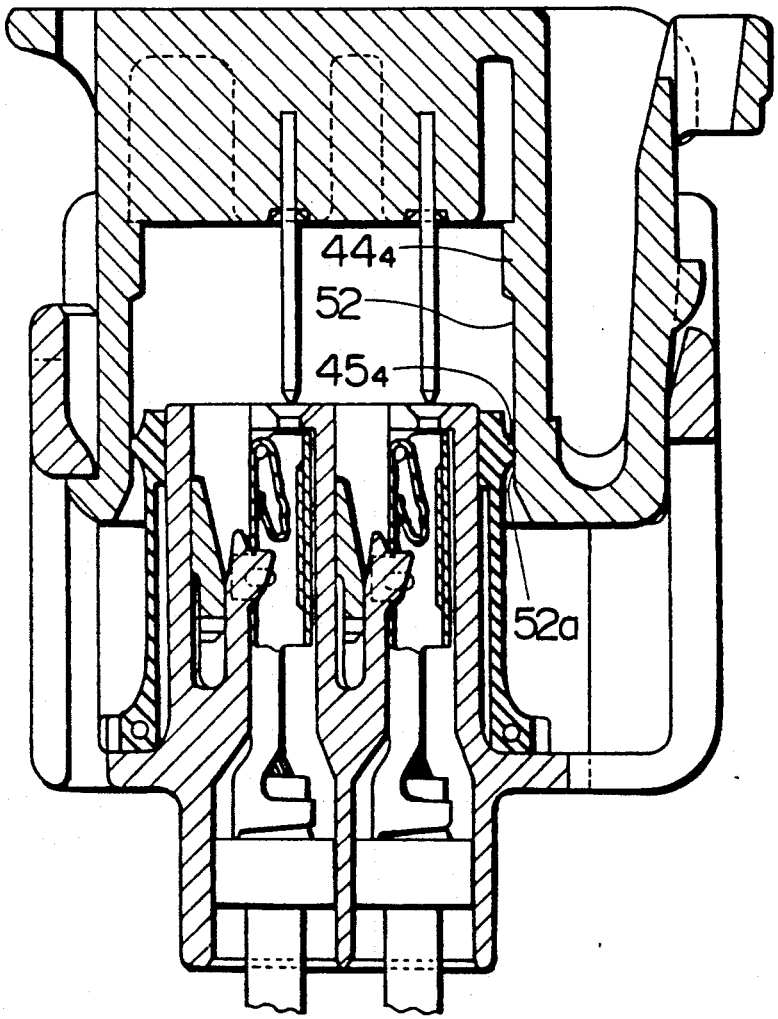
FIG. 14 is a vertical sectional view showing a modification to the switch connector assembly of FIG. 11 when the male and female connectors are temporarily fitted with each other.
Figure 15:
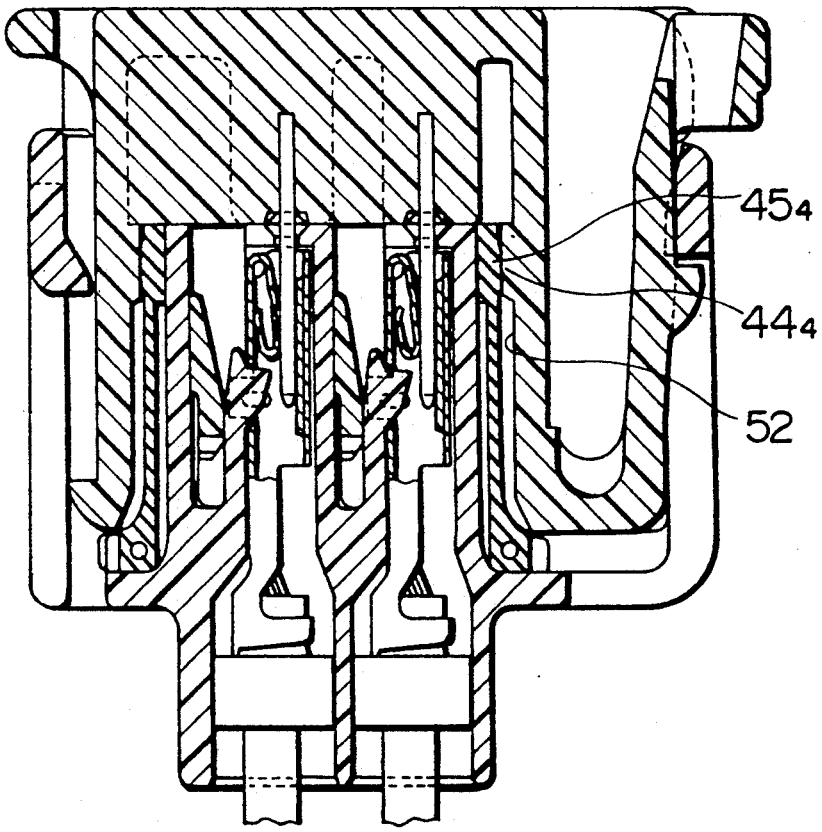
FIG. 15 is a similar view but showing the modified connector assembly of FIG. 14 when the male and female connectors are finally fitted with each other.
Figure 16:
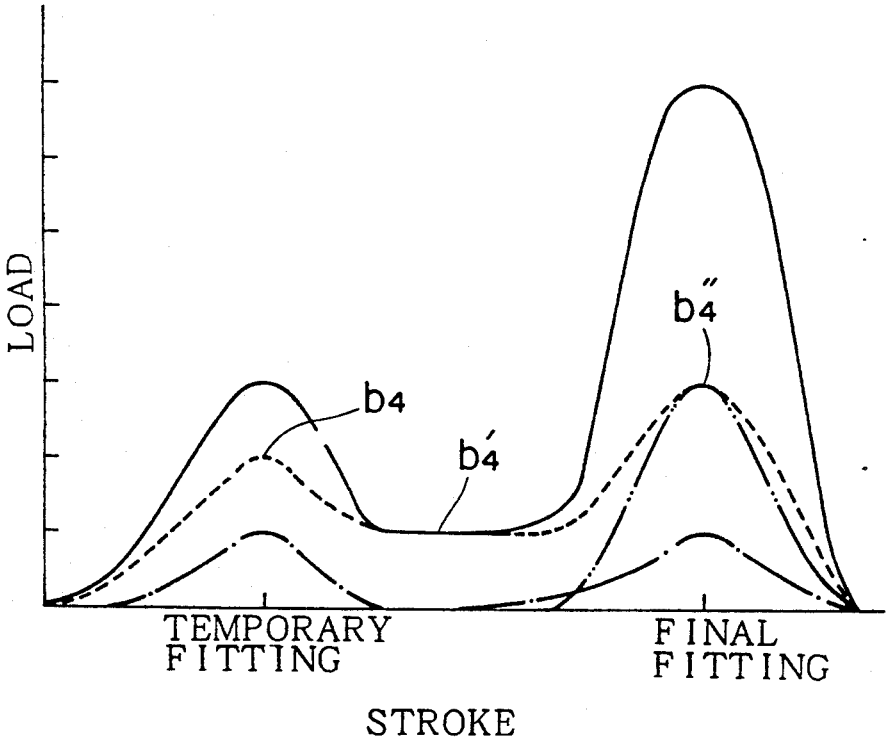
FIG. 16 is a diagram showing a relationship between a connector inserting force and a stroke of the male and female connectors of the switch connector assembly of FIG. 14.
Figure 17:
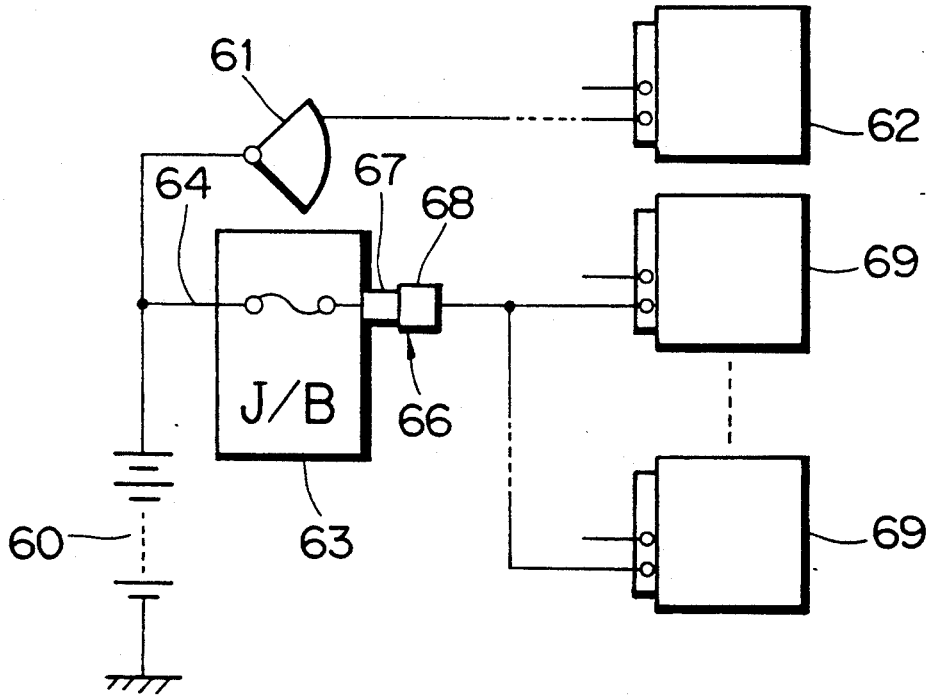
FIG. 17 PRIOR ART
FIG. 17 is a circuit diagram of an electric circuit which employs a conventional switch connector assembly.

Referring now to FIGS. 14 and 15, there is shown a modification to the switch connector assembly of the third embodiment described above with reference to FIGS. 11 and 12. The present switch connector assembly is modified such that a recessed groove 52 of a connector fitting chamber inner wall $44_4$ which contributes to application of a reduced interference to a sliding seal $45_4$ and corresponds to the recessed groove 51 described above extends to an opening end portion 52*a* so to reduce resistances $b_4$ and $b_4'$ of the sliding seal $45_4$ upon temporary fitting and upon insertion stroke thereby to enhance the inserting operability and to make it possible to achieve sure waterproof upon final fitting by close contact (inserting force $b_4''$) between the sliding seal $45_4$ and the inner wall $44_4$ on the base end side.

Having now fully described the invention, it will be apparent to one of ordinary skill in the art that many changes and modifications can be made thereto without departing from the spirit and scope of the invention as set forth herein.

What is claimed is:

1. A switch connector assembly with a waterproof structure, comprising:

a first connector having a connector fitting chamber formed therein and having a short-circuiting terminal extending therefrom into said connector fitting chamber, said first connector having thereon a temporary arresting projection and a flexible locking arm having a final arresting projection thereon:

a second connector for being inserted in said connector fitting chamber, said second connector having thereon a connecting terminal for contacting with said short-circuiting terminal, a flexible engaging pawl for engaging with said temporary arresting projection, and an engaging portion for engaging with said final arresting projection:

said first and second connectors being so shaped and dimensioned that said short-circuiting terminal and said connecting terminal are kept out of contact with each other when said temporary arresting projection is fitted with said flexible engaging pawl, but contact with each other when said final arresting projection is fitted with said engaging portion; and a sliding seal provided on an outer peripheral wall adjacent an end of said second connector for engaging with an inner wall of said connector fitting chamber, said sliding seal being located so as to be engaged, when said second connector is inserted into said connector fitting chamber of said first connector, with said inner wall of said connector fitting chamber simultaneously when said temporary arresting projection and said flexible engaging pawl are fitted with each other.

2. A switch connector assembly with a waterproof structure as claimed in claim 1, wherein a taper guide is formed at an opening end portion of an inner wall of said connector fitting chamber for guiding said sliding seal upon insertion of said second connector into said connector fitting chamber.

3. A switch connector assembly with a waterproof structure as claimed in claim 1, further comprising a fixing seal provided on said outer peripheral wall adjacent a base end of said second connector, said fixing seal being closely contacted with said second connector simultaneously when said final arresting projection and said engaging portion are fitted with each other upon insertion of said second connector into said connector fitting chamber of said first connector.

4. A switch connector assembly with a waterproof structure as claimed in claim 3, wherein said sliding seal and said fixing seal are formed as a unitary member. waterproof structure as claimed in claim 1, wherein a taper guide is formed at an opening end portion of an inner wall of said connector fitting chamber for guiding said sliding seal upon insertion of said second connector into said connector fitting chamber.

5. A switch connector assembly with a waterproof structure as claimed in claim 1, wherein a recessed groove is provided circumferentially at an intermediate portion of an inner wall of said connector fitting chamber in the inserting direction of said second connector into said first connector in such a manner that said sliding seal is not contacted with the inner wall of said fitting chamber when said second connector is inserted into said connector fitting chamber.

6. A switch connector assembly with a waterproof structure as claimed in claim 5, wherein said recessed groove extends to an opening end portion of said connector fitting chamber.

* * * * *